US005524460A

United States Patent [19]

Michetti et al.

[11] Patent Number: 5,524,460

[45] Date of Patent: Jun. 11, 1996

[54] DEVICE FOR CONTINOUSLY MONITORING THE NEEDLES OF A KNITTING MACHINE DURING OPERATION THEREOF

[75] Inventors: Paolo Michetti; Andrea Michetti, both of Almese, Italy

[73] Assignee: Microtex Sas di Dott. L. Michetti, Almese, Italy

[21] Appl. No.: 338,615

[22] PCT Filed: May 26, 1993

[86] PCT No.: PCT/EP93/01259

§ 371 Date: Nov. 23, 1994

§ 102(e) Date: Nov. 23, 1994

[87] PCT Pub. No.: WO93/24691

PCT Pub. Date: Dec. 9, 1993

[30] Foreign Application Priority Data

May 26, 1992 [IT] Italy ..... TO92A0449

[51] Int. Cl.[6] ..... D04B 35/18

[52] U.S. Cl. ..... 66/165; 66/157; 250/559.29

[58] Field of Search ..... 66/157, 165; 250/561, 250/221

[56] References Cited

U.S. PATENT DOCUMENTS

| | | | |
|---|---|---|---|
| 3,771,325 | 11/1973 | Sweeney et al. | 66/157 X |
| 3,904,529 | 9/1975 | Nakamura | 66/157 X |
| 3,937,038 | 2/1976 | Sick | 66/157 |
| 3,946,578 | 3/1976 | Venczel | 66/157 |
| 4,027,982 | 6/1977 | Ohishi | 356/227 |
| 4,716,942 | 1/1988 | Jensen et al. | 250/561 X |
| 4,979,402 | 11/1990 | de Vuyst et al. | 250/561 |
| 5,266,812 | 11/1993 | Mokuo | 250/561 |
| 5,294,803 | 3/1994 | Pahr | 250/561 |
| 5,369,284 | 11/1994 | Bellio | 250/561 |

FOREIGN PATENT DOCUMENTS

| | | |
|---|---|---|
| 2242266 | 3/1974 | Germany . |
| 2538002 | 3/1977 | Germany . |
| 1186985 | 4/1970 | United Kingdom . |

*Primary Examiner*—John J. Calvert

*Attorney, Agent, or Firm*—Sughrue, Mion, Zinn, Macpeak & Seas

[57] ABSTRACT

The needles of a knitting machine are continuously monitored, during operation of the machine, by an optical head having a light source and an electro-optical receiver which receives the light beam from the light source after the beam has crossed the area of passage of the needles. The output signals from the receiver are sent to an electronic control unit.

19 Claims, 5 Drawing Sheets

FIG. 1
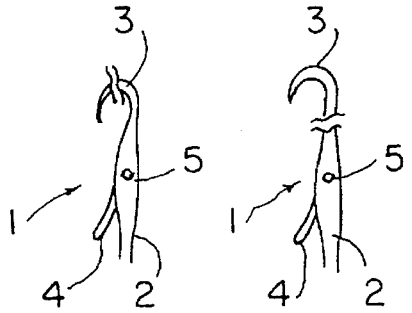
FIG. 2
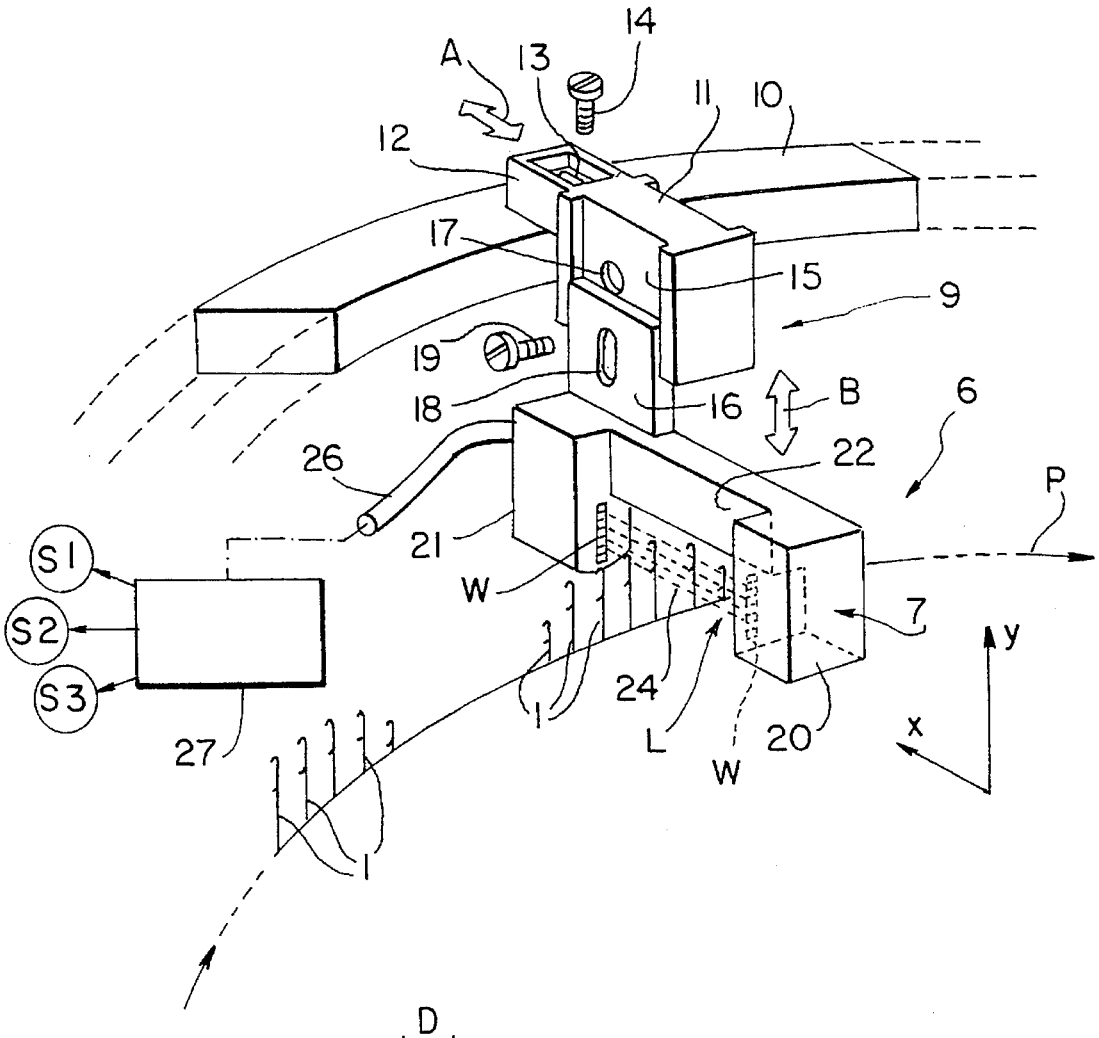
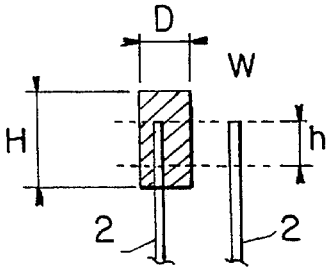
FIG. 3

FIG.4
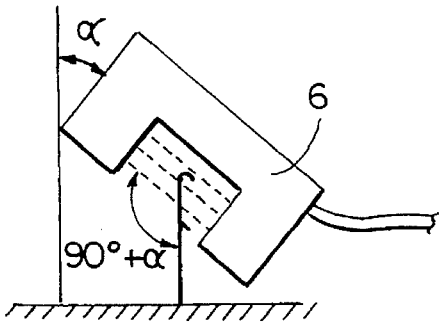
FIG.5
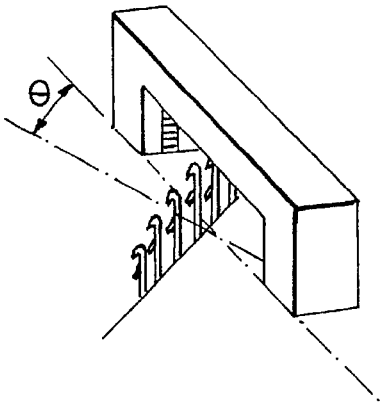
FIG.6
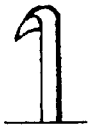
FIG.7
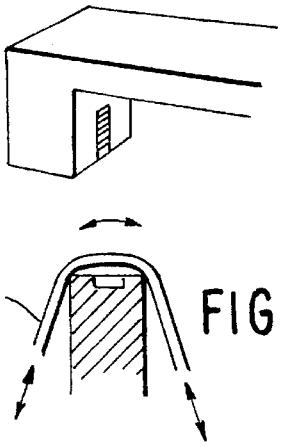
FIG.7a
FIG.8
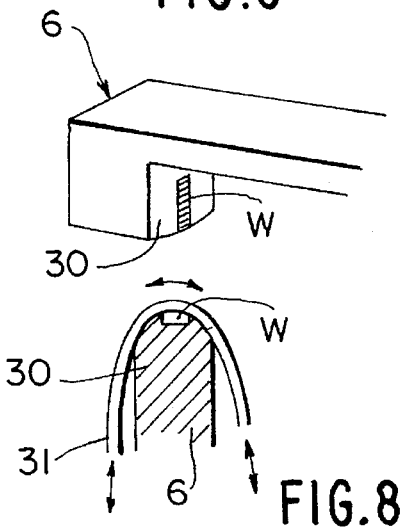
FIG.8a
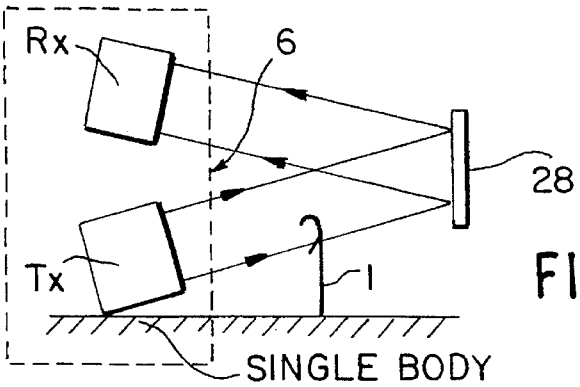
FIG.9

50
LEVEL
POSITION
51
35
CORRECT INSTALLATION
33
CL
34
ENVELOPE DEMODULATOR
36
SELF-SYNCHRONIZING CLOCK GENERATOR
CLK
40
ENVELOPE DEMODULATOR
39
LOW-PASS FILTER
38
SINGLE WAVEFORM EXTRACTOR
Ve
Vf
i
i-1
Vinv
43
THRESHOLD
α
SENSITIVITY
45
Vref = αVinv
42
CL
Vn
44
PROCESSING LOGIC
41
NEEDLE CONFIGURATION
Vin
32
AMP
6
26
46
PC
47
OSC
48
DIGITAL OUTPUTS
49
INDICATORS FIG.13
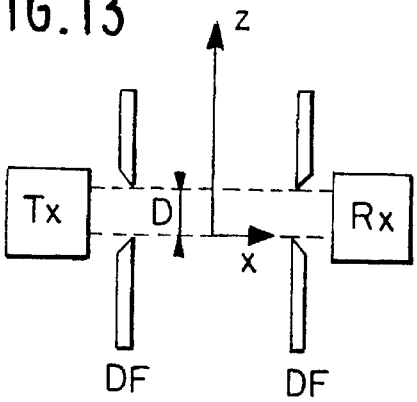
FIG.14
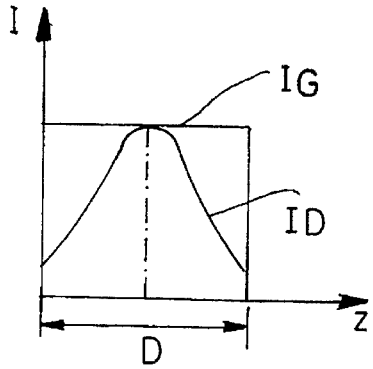
FIG.16
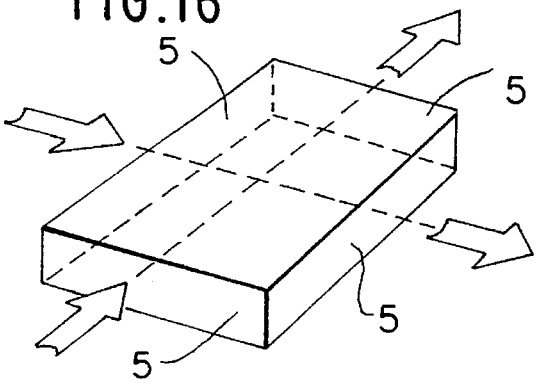
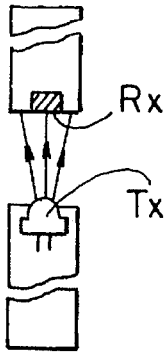
FIG.15
FIG.17
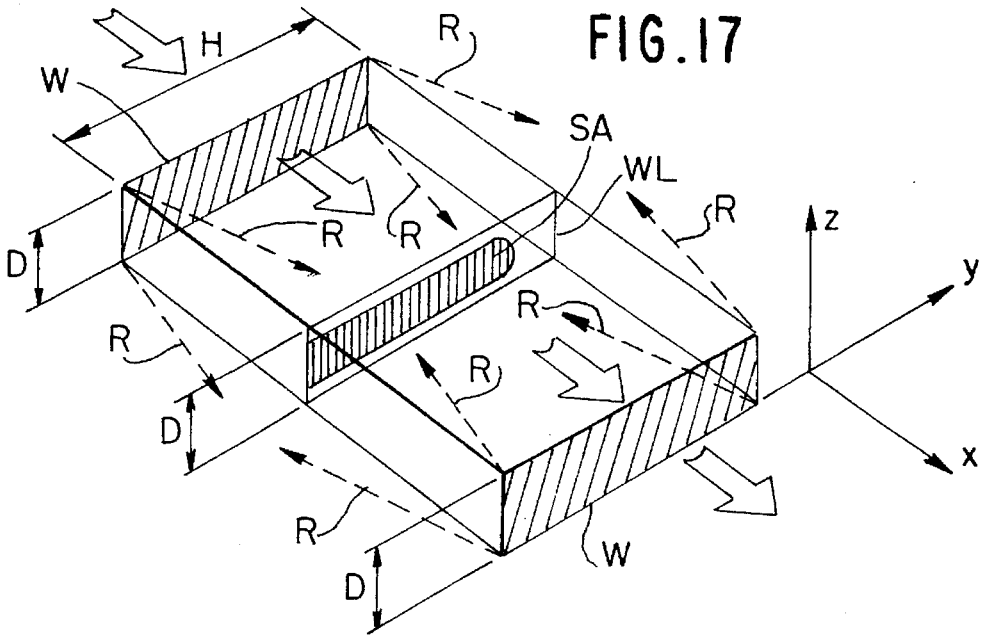

DEVICE FOR CONTINOUSLY MONITORING THE NEEDLES OF A KNITTING MACHINE DURING OPERATION THEREOF

TECHNICAL FIELD

The present invention relates to knitting machines and particularly to devices for continuously monitoring the needles used in such machines.

FIG. 1 of the annexed drawings shows, by way of example, two typical failures of a needle of a type used in such knitting machines.

FIG. 1 shows a needle 1 of the so called "tab-type" or "automatic-type", comprising a stem 2 ending with a hook 3 and a tab 4 pivoted in 5 to stem 2 and movable between an open position, shown in the figure, and a closed position, in which it defines the needle eye together with the hook 3.

Such needles are subject to a continuous mechanical stress, due to the pulling action exerted by the needle on the yarn; this stress, which takes place with every action of the needle on the yarn, causes a fatigue condition which may lead to the failure of the needle. This failure usually takes place in the area of hook 3, as visible in FIG. 1, and may be preceded by a stage of relevant deformation of the shape of the hook, usually consisting in a torsion deformation and in an opening movement of the hook.

The failure of a needle of a knitting machine during operation thereof has the consequence of a production of faulty fabric due to the absence of the loop corresponding to the broken needle. This results in an economical damage which may be very relevant, considering the very high production speed of the piece or cloth of fabric by the machine, as well as the fact that quite often the faulty fabric cannot be used.

BACKGROUND ART

In the absence of automatic control devices, the production of the faulty fabric goes on until the fault is visually noticed by the machine operators. This happens with a delay depending accidentally upon various factors, since the operator usually attends to various machines and to various tasks on each machine, beside controlling the product quality.

In the endeavour to overcome this drawback, there have been provided devices for the continuous and automatic check of the needles during the operation of a knitting machine. Most of the devices which are being presently marketed are based on electro-optical techniques which exploit the principle of the optical reflection.

Devices of this kind are described for example in U.S. Pat. Nos. 4,027,982 and 3,937,038.

Such reflection-type devices comprise a light emitting device, able to direct a light beam in the direction of a detecting area which is crossed in sequence by the needles during the operation of the machine, and a receiving device, which receives the light reflected by the needles. If the needles are not correctly positioned, are deformed or broken, the quantity of reflected light energy changes, and this is detected, at least theoretically, by the receiving device.

The electro-optical devices based on the principle of the optical reflection, however, have a number of drawbacks. First of all, installing the detector is difficult because of the need to search critical alignment conditions with respect to the path of the needles, conditions which may be kept with difficulty.

Furthermore, the device is not precise, since it tends to overview broken needles or to consider unbroken needles as being broken. Consequently, wrong decisions are taken in controlling the operation of the machine.

Finally, the performance of the device depends in an unacceptable way from the cleanness condition of the detector.

Solutions have also been tested based on the principle of the optical transmission, as, for example, the devices disclosed in U.S. Pat. Nos. 3,659,346 and 3,946,578.

For instance, the device disclosed in U.S. Pat. No. 3,946,578 comprises a light emitting device, able to direct a light beam in the direction of a detection area crossed by the needles, and two (or more) receiving devices (or surfaces) which receive the light emitted by the emitting device.

The needles, travelling across the detection area, intercept part of the light directed towards the receiving devices. In this manner, such receiving devices are able to show when the respective portions of the detection area are crossed by each needle.

The detection of the faulty needles is made by checking that the needles cross all the portions of the detection area controlled by the receiving devices, in the correct time sequence. The detection is possible in fact due to the specific shape and arrangement of the receiving devices, which are such that the faulty needles do not cause a correct time sequence.

This detection system has drawbacks similar to those of the reflection-type devices. As a matter of fact, for a correct operation of the device, it is necessary that the configuration and installation of the detecting electro-optical devices are very accurate and designed specifically for controlling a given type of needles.

In this way, the operation of the device is very critical, particularly with respect to variations of position of the installed device, vibrations, as well as variations in speed or type of operation of the knitting machine.

These drawbacks of the devices of the prior art render the performance of such devices not fully satisfactory, and cause a decrease of such performance during the operation.

GB-A-1 186 985 discloses a device for continuously monitoring the needles of a knitting machine during operation thereof, comprising:

a detecting optical head, comprising a main structure carrying:

a light emitting source, first optical means for receiving the light emitted by said source and guiding said light up to an emitting window, for emitting a light beam obtained thereby in the direction of a detecting area which is crossed in sequence by the needles of the knitting machine during operation thereof, a receiving window which is located in such a way as to receive said light beam after that the latter has crossed the detecting area, second optical means for receiving the light of said beam coming into said receiving window and for guiding said light up to an electro-optical receiver, said receiver being able to emit an electric signal indicating the light energy which comes to the receiver as being not intercepted by the needle which is at each time at the detecting area, and a control electronic unit for receiving the signals emitted by said electro-optical receiver and processing such signals in order to detect any broken needle passing through the detecting area.

A device of this kind is generally able to select between broken and unbroken needles, but is not able to secure an information on the general configuration of the needle, so that unbroken needles which are nevertheless defective, such as bended needles, cannot be detected. Moreover, the control operation carried out by the electronic unit of this known device is based on a comparison between the output data relating to the needle which is being monitored and standard reference data, so that the monitoring operation may be affected by operating conditions of the machine.

The object of the present invention is to overcome all the drawbacks of the prior art.

DISCLOSURE OF THE INVENTION

The present invention is directed to a new and improved device for continuously monitoring the needles of a knitting machine during operation thereof, comprising a detecting optical head, comprising a main structure carrying a light emitting source, first optical means for receiving light emitted by said source and guiding said light up to an emitting window for emitting a light beam obtained thereby in the direction of a detecting area which is crossed in sequence by the needles of the knitting machine during operation thereof, a receiving window which is located in such a way as to receive said light beam after that the latter has crossed the detecting area, second optical means for receiving the light of said beam coming into said receiving window and for guiding said light up to an electro-optical receiver, said receiver being able to emit an electric signal indicating the light energy which comes to the receiver as being not intercepted by the needle which is at each time at the detecting area, a control electronic unit for receiving the signals emitted by said electro-optical receiver and processing such signals in order to detect any broken needle passing through the detecting area, said first and second optical means include planar-type optical guide means, each comprising at least one flattened plate of dielectric material having two parallel major faces, a light inlet surface and a light outlet surface which lie in planes orthogonal to said major faces, for guiding light rays, entering into said plate from said inlet surface between said major faces up to said outlet surface, said emitting and receiving windows are the outlet surface and the inlet surface of respective optical guide plates of said first and second optical guide means, wherein the light beam crossing said detecting area has a rectangular elongated cross-section and a substantially uniform distribution of the light intensity throughout this cross-section so that said signals emitted by said receiver contain not only information necessary to select between broken and unbroken needles, but also information on the general configuration of the needle which enables any type of defective configuration to be detected; said electronic unit comprising extracting means adapted to extract from said signals emitted by said electro-optical receiver output signals independent from variations relating to the environment of operation of the device; means adapted to compare said output signals relating to one of said needles with output signals relating to a preceding one of said needles which has already passed through the detecting area, so that the needle monitoring operation is independent from variations relating to the type and width of the needles, the operating conditions of the knitting machine and the initial calibrating operations of the device, said device further comprises support means for adjustably supporting said optical head on a fixed part of the knitting machine.

BRIEF DESCRIPTION OF THE DRAWINGS

The invention will be now described with reference to the annexed drawings, given purely by way of non limiting example, in which:

FIG. 1 shows needle defects,

FIG. 2 is a diagrammatic perspective view of a device according to the invention in a condition mounted on a knitting machine, FIG. 3 is a diagrammatic view which shows the principle of operation of the device according to the invention, FIGS. 4, 5 show two further variants of the device, FIG. 6 is a diagrammatic view which shows the principle of operation of the variant of FIG. 5, FIGS. 7, 7*a* and 8, 8*a* are diagrammatic views which show a further detail of the device according to the invention, FIG. 9 is a diagrammatic view which show a variant of the device according to the invention, FIG. 14 is a diagram which shows a feature of the transmission-type devices, FIG. 16 is a diagrammatic view which shows the principle of operation of a component of the device according to the invention, and FIG. 17 is diagrammatic view which shows the operation of the device according to the invention.

MODES FOR CARRYING OUT THE INVENTION

Figure 10:
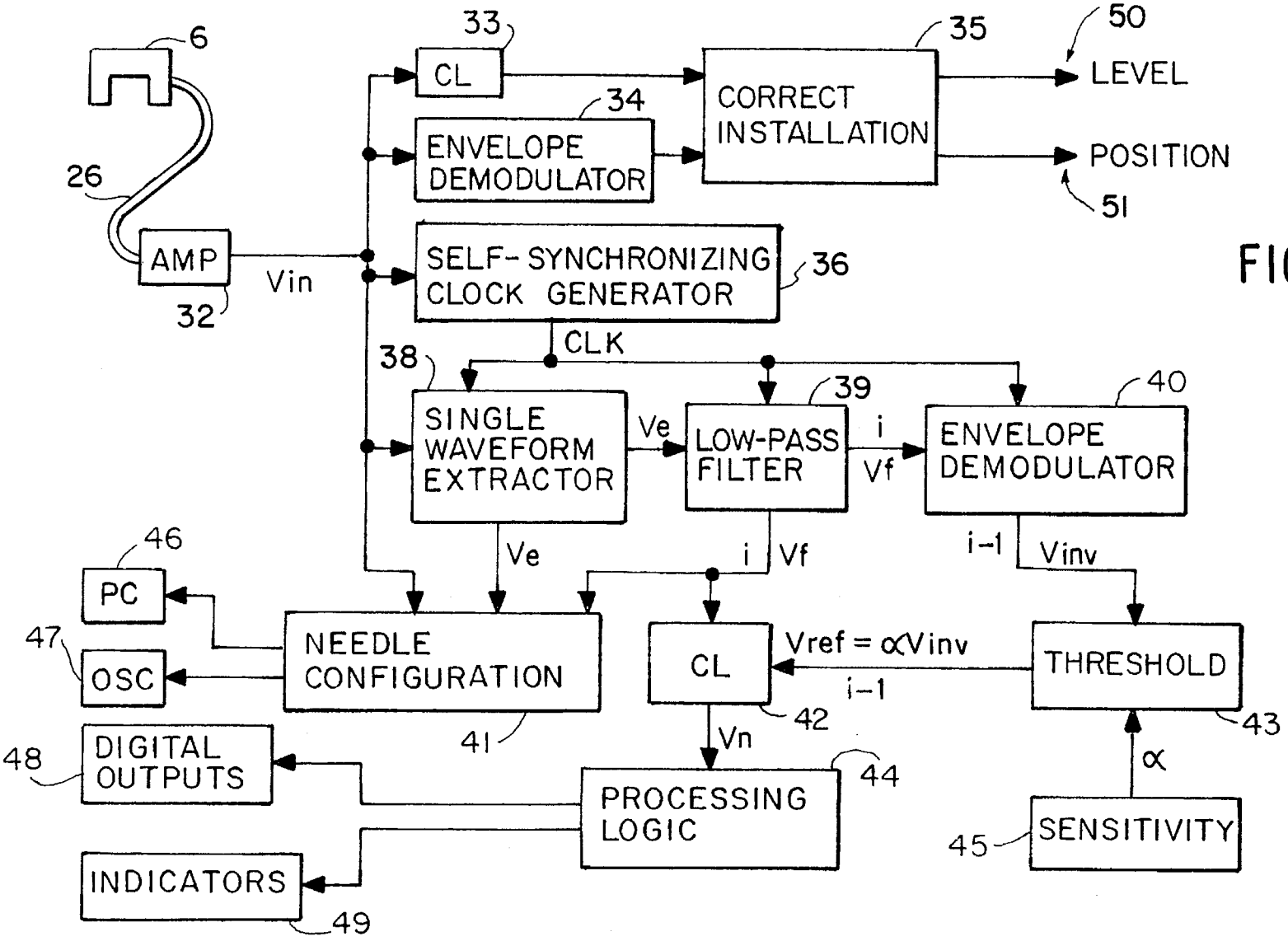
FIG. 10 is a block diagram of the control unit of the device according to the invention.

With reference to FIG. 2, reference numeral 6 generally designates an optical head forming part of the device according to the invention. The optical head 6 has a supporting structure 7 which is fixed to a part of the knitting machine by support means 9 which allow the position in space of structure 7 to be adjusted.

With reference to the specific example illustrated in the annexed drawings, structure 7 of the optical head 6 is connected to a fixed ring 10 forming part of the structure of a circular knitting machine, by means of an adjustment support 9.

The adjustment support 9 includes a first element 11 having a connecting portion 12 which has a slot 13 for engagement of a fixing screw 14. The arrangement of the slot 13 allows fine adjustment of the position of the connecting portion 12 along a radial direction indicated by arrow A. Element 11 on its turn comprises a guide portion 15 where is vertically slidably mounted a connecting portion 16 joined to the supporting structure 7 of the optical head 6. Elements 15, 16 have a hole 17 and a slot 18 respectively for engagement of a fixing screw 19. The slot 18 allows fine adjustment of the position of the optical head 6 in the vertical direction indicated by arrow B, before tightening of screw 19.

Naturally, the adjustment means 9 may have any other configuration adapted to allow a fine adjustment of the position in space of structure 7.

Also with reference to the specific example illustrated in the annexed drawings, structure 7 has a bridge-like configuration, with two side elements 20, 21 connected by a cross member 22. The optical head 6 is positioned in space so that it bridges the path P of travel of needles 1 of the knitting machine. Naturally, as it has already been mentioned, the configuration of support 9 of optical head 6 is chosen so as to allow said positioning by simple operations and to ensure that such positioning is kept with the time.

The configuration of support 9 is also chosen so that it may be adapted to the specific needs of mounting and installation required by the various types of knitting machines.

According to the conventional art, during operation of the machine, needles 1 are forced to move along path P and are simultaneously subject to a reciprocating movement which brings them to protrude periodically from the guide structure or to retract within such structure.

FIG. 2 shows the simplest case in which the needles are mounted on a single path P. However there are machines in which the needles are mounted along two separate paths. It is clearly appearent that the invention is applicable also to this latter case.

The optical head 7 carries a light emitting source which emits a light beam L in the direction of a detecting area 24 which is crossed in sequence by the needles 1 of the knitting machine during operation of the latter, and an electro-optical receiver which is located so as to receive the light beam L after that this has crossed the detecting area 24.

The electrical-optical receiver is able to generate, in a way known per se, an electrical signal indicating the received light energy, which is obviously a fuction of the quantity of light energy intercepted by the needle 1 which is at the detecting area.

The detecting devices of the transmission type require, for best performaces, that the light beam L which is used has an intensity distribution which is as far as possible uniform in the cross section orthogonal to the direction of view. Only with an intensity distribution of this type signal variations caused by an object interposed between the transmitter and the receiver are directly proportional to the fraction of the beam intercepted thereby, and may be directly associated with the shape of the object under examination.

In the case of detectors of the transmission type, according to the prior art, it is observed that the use of conventional electro-optical devices, having in some case emitting (receiving) surfaces whose shape is defined by means of diaphragms, does not allow a suitable distribution of the light intensity in the cross section of the light beam L.

In FIG. 13, there is shown a detector of the transmission type comprising two conventional electro-optical devices Tx and Rx, transmitter and receiver respectively, for example a L.E.D. and a phototransistor, with two diaphragms DF associated therewith in order to define the shape of a light beam having a cross section with a width indicated by D in the direction indicated by z in the figure.

In FIG. 14, there is shown the value Id of light intensity I, versus z, of the light beam of the device of FIG. 13.

As it may be seen, the distribution of intensity Id has a strong curvature and is far from the ideal distribution with uniform intensity shown with curve Ig.

A result similar to Id is obtained also with a conventional device configured as shown in FIG. 15, in which the light emitting source Tx is an unmasked L.E.D., which emits therefore a light beam with a cross section which is not rectangular, only a part of which is received by the optical window Rx.

The present invention provides a system to obtain a light beam L with uniform distribution and at the same time with limited cross-section, having therefore a light intensity distribution substantially similar to that shown with Ig in FIG. 14, consisting in the use of planar optical guides.

Planar optical guides are non-conventional optical devices, which have the property of affecting the light propagation between an emitter and a receiver so that the propagation takes place in a guided way according to the desired characteristics. The light guiding effect is obtained by the use of plates of dielectric material, having uniform thickness, which due to the property of optical restraint of the dielectric materials, allow a propagation of bidimensional type to be obtained. In particular, the side surfaces S of such planar dielectric plates may be used as surfaces for inputting and outputting light rays as shown in FIG. 16. By defining a suitable shape of such plates it is possible also to obtain a bidimensional propagation according to the desired paths and distributions.

In FIG. 17 there is shown a configuration of the light beam obtained by planar optical guides.

The planar optical guides, both for emitting and for receiving light, have emitting/receiving surfaces or windows W whose dimensions directly depend upon the average dimensions of the needles which are used. This characteristic is shown also in FIG. 3. In particular, the width D, along direction z, is preferably greater than the width of the stem 2 of the needles with respect to the direction of view and is also preferably lower than the distance between two adjacent needles. The height H of window W must be obviously greater of the portion h of the needle (visible in FIG. 3) to be put under observation.

Consequently, a transmitted light beam is defined having a cross section WL with the same shape and size of the surfaces W. In the cross section WL of FIG. 17 there is shown also the portion SA which is intercepted by a needle which is in the optical channel.

The beam emitted and received by surfaces W of the planar optical guides opens slightly in the plane xz of FIG. 17, as indicated by rays R while it remains collimated in the plane xy, and has a substantially uniform distribution.

Furthermore, the use of planar optical guides allows a more efficient use of the light source because the guided transmission brings on the receiver a much greater portion of the light emitted by the light source with respect to the conventional devices.

The electric signals generated by the electrical-optical receiver are transmitted by a line 26 to a control electronic unit 27, which will be now described with reference to FIGS. 10, 11 and 12.

Figure 11:
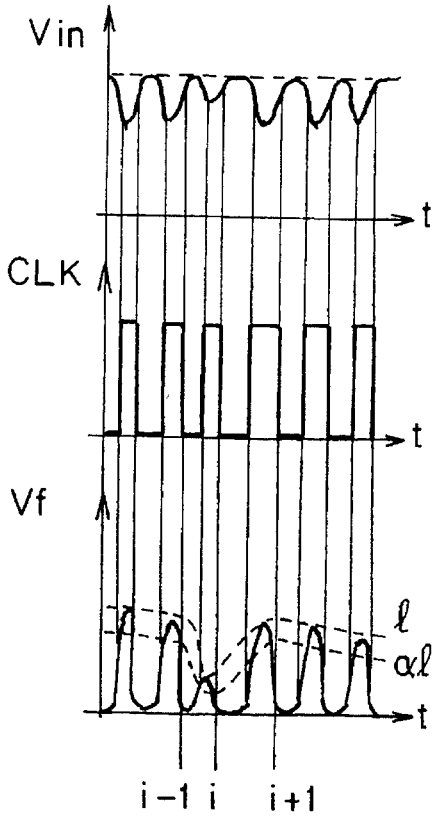
FIGS. 11 and 12 are representations of the signals of the control unit of FIG. 10, FIGS. 13 and 15 are diagrammatic views of two transmission-type devices forming part of the prior art.
Figure 12:
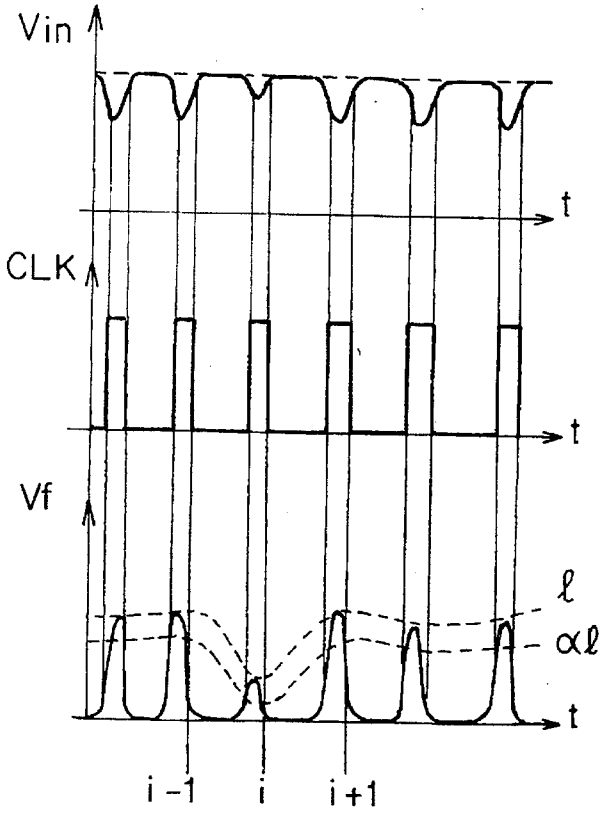

Control unit 27 comprises an amplifier 32 having the function of amplifying the signal coming from the electrical-optical receiver in order to provide an output amplified signal Vin, shown in FIGS. 11 and 12, to the various functional units of the control unit 27. The two figures refer to similar sequences of needles, having different frequence and width.

A first functional unit comprises a lever comparator 33, and an envelope demodulator 34 which receive as an input the signal Vin and have their outputs connected to a correct-installation module 35 of which they are the inputs. As a function of the level and the envelope of the signal Vin, the module 35 for controlling the correct installation emits two outputs, 50 and 51, respectively, indicating the achievement, with respect to the installation of the device, of a correct level of the received signal, and a correct positioning of the optical head 7.

A second functional unit is provided to control that the needles 1 are faultless. This unit comprises a module 36, adapted to receive signal Vin as an input and to output clock signals CLK in synchronism with the waveforms Vin corresponding to the various needles.

These clock signals CLK, also visible in FIGS. 11 and 12, are used as inputs by three further modules of the unit: a single waveform extracting module 38, a low-pass filter 39 and an envelope demodulator 40. The single waveform extractor 38 also receives as an input the signal Vin and has the purpose of translating into a single level information the single waveforms produced by needles 1 and to emphasize the differences referring to a 0 level; its output is constituted by a signal Ve.

This signal Ve is subject to fluctuations typical of a sequence of unbroken needles mounted on a knitting machine. For this reason, it is necessary to filter signal Ve by a low-pass filter in order to reduce the chance of faulty detections. Filter 39 therefore has an input signal Ve and has an output signal Vf, visible in the figures.

Filter 39 also has the non-conventional characteristic to introduce a phase difference null in frequence, to allow the device to operate in a way independent from the frequence, without the need of adjustment from outside.

Signal Vf is a further input of the envelope demodulating module 40. The purpose of this module is to create an output signal Vinv which is substantially a level signal relative to the previous needle, in respect of the needle which is crossing the optical head 6.

As a matter of fact, the device according to the present invention does not perform the comparison of the needle under examination with a threshold fixed value during the installation, but rather with a threshold value obtained from the needles which have just crossed the detection area.

In this way, the result is obtained that the comparison check for locating any failure in the needles is no longer affected by speed variations, type of operation, vibrations or other disturbing factors. As a matter of fact, the device is continuously self-calibrating.

Signal Vinv goes into a module 43 whose purpose is that of generating an output signal Vref. Module 43 supplies the threshold for the comparison, i.e. the reference signal Vref, by multiplying signal Vinv by a sensitivity coefficient $\alpha$, fixed in 45 at installation. Signals Vinv and Vref supply the level information used for the comparison, and such level is represented in FIGS. 11 and 12 by the dotted lines indicated by l and $\alpha$l respectively.

The comparison between the needle presently being examined, or needle i, and the previous needle, or needle i−1, is carried out in module 42 which includes a level comparator.

The inputs of module 42 therefore are signal Vf, relating to needle i, coming from filter 39, and the reference or threshold signal Vref, relating to needle i−1, described above.

For each needle, comparator 42 then compares the two above mentioned signals; in case is Vf>Vref, the device proceeds in its checking function, naturally updating the two signal Vf and Vref relating to the next needle to be checked; in case is Vf≦Vref, comparator 42 will show, by its output Vn, that a faulty needle has been detected.

Output Vn is the input of a processing module 44, which, upon receiving an input signal Vn indicating a faulty needle, carries out the necessary operations which tipycally consist in stopping the knitting machine and activating a signal for the operator.

Such operations are carried out by modules 48 and 49 respectively, which are provided to this purpose.

The control unit 27 further comprises an auxiliary unit, essentially consisting of a module for controlling the configuration of needles 41. This module receives input signals Vin, Ve and Vf, which have been described above, and renders them accessible for devices outside the control unit 27 in order to let them be displayed or processed. Such outside devices can be for example an oscilloscope 47 or a suitably arranged personal computer 46.

FIG. 9 diagrammatically shows a further variant, in which the transmitting portion and the receiving portion lie on a same side with respect to the needles 1 to be observed. In this case, a mirror 28 is used to deviate the light beam coming from transmitter Tx after that the latter has crossed the detecting area, in the direction of receiver Rx. Such solution is preferred in those cases in which, for construction or dimensional needs, it is not possible to use the solution illustrated in FIG. 2.

FIGS. 4, 5 show two further variants which are characterised by a greater detecting sensitivity.

As apparent from FIG. 1, the failure of the needle can take place both along the curvature of the hook 3 (left portion of FIG. 1) and along the stem portion which is next to the hook (right portion). In order to detect also failures of the type illustrated in the left portion of FIG. 1, the optical head 6 can be inclined in the way illustrated in FIG. 4, so that the optical channel is not orthogonal to the needle direction. FIG. 5 shows another solution in which the optical head 6 is rotated in a horizontal plane, so that the direction of the optical channel is not orthogonal to the plane of the needles. In this way, the needle image along the direction of the optical channel is that illustrated in FIG. 6 which allows failures of the end portion of the hook to be detected.

Preferably, the control unit 27 is provided with display lights which make the installation of the device easier and correspond to the functions carried out by the correct-installation module 35 as previously described. In particular, control unit 27 may be provided with a first display light S1, indicating the light intensity of the optical channel used by the detecting head. This first display light corresponds to the level output 50 of said module 35. Due to the adoption of a detecting system having the characteristics described above, the said adjustment is totally independent from the type of knitting machine, the type of needles which are used and the needle width and in general from any particular characteristic of any operation going on. Furthermore, a second display light S2 is provided, which shows when the sensor has been positioned in the proper way with respect to the needle sequence. This second display light corresponds to the position output 51 of said module 35.

Also this display is totally independent from the type of knitting machine, the type of needles which are used, the width thereof and the particular features of the operation going on, as well as from said level display of the light intensity of the optical channel.

The two said displays S1, S2 allow the device to be installed properly, and also provide an instant by instant information, while the knitting machine is operating, on whether the light intensity of the optical channel and the positioning of the sensor remain correct, once the initial installation has been carried out.

Another drawback of the devices used up to now lies in that the knitting machines usually operate in difficult environmental conditions.

As a matter of fact, in the surrounding air, there is present a substantial quantity of textile particles of little size, generated by the working process. Furthermore, there are present particles of the oils for the lubrication of the moving parts. The flying fibers and the oil particles tend to form a sort of greasy felt on every surface of the textile machine, including the surfaces of the detecting head, so as to decrease the intensity of the light beam used for the needle detection, until the whole device is rendered inoperative.

The control unit 27 is also able to display (S3) any dimming of the sensor due to the deposit of impurities, so as to invite the operator to proceed with the removal of the undesired deposit. An essential feature of the control unit is its ability of continuing to operate properly for a long time from the moment in which the progressive dimming of the optical channel has commenced.

This feature allows the textile process to proceed undisturbed with no faults, and the operator to attend to cleaning of the sensor according to the usual timing of the general maintenance operations without that any exceptional or repeated intervention is needed.

The control unit 27 automatically provides to stop the machine on which it is installed as soon as the dimming of the optical channel has reached and passed an acceptable maximum value, so that it is no longer possible to ensure a proper operation of the system.

In this manner, one avoids uncontrolled production of textile with faults due to needle failures, which would represent a much greater damage with respect to a temporary stop of the process.

Thus, the operator is forced to proceed to the cleaning operations, which can be carried out in a particularly easy way, due to a further feature of the device according to the present invention which will be now described.

The undesired deposit of said particles is particularly relevant on the surfaces which have some discontinuance, as areas joining planar elements, edges, steps, etc.

Still a worse consequence is that unqualified personnel are not able to remove the undesired deposits in short time and easily from such discontinuous surfaces, as it is instead required by the continuous operation of the textile machine and the lack of specific training of the personnel.

According to the invention, the detecting head is so arranged as to have its transmission and reception optical windows not lying on a planar surface, but rather on a cylindrical surface, as that indicated by 30 in FIG. 8. This measure allows an easy removal of the undesired deposits by simply rubbing a rag 31, held on the back side of the portion to be cleaned, as illustrated in FIG. 8*a*. On the contrary, in the case of an edged shape (see FIGS. 7, 7*a*) it is not possible to carry out an easy clean operation since the rag 31 is not able to adhere effectively to the optical windows, because of the edges of the structure.

Naturally, the principle of the invention remaining the same, the details of construction and the embodiments may widely vary with respect to what has been described and illustrated purely by way of example, without thereby departing from the scope of the present invention.

What is claimed is:

1. A device for continuously monitoring the needles of a knitting machine during operation thereof comprising:

a detecting optical head having a main support structure;

a light emitting source and an electro-optical receiver mounted on said main support structure in spaced apart relation to define a detecting area therebetween which is crossed in sequence by the needles of the knitting machine during operation thereof;

first optical means coupled to said light emitting source for receiving and guiding light emitted by said source toward said electro-optical receiver across said detecting area;

second optical means coupled to said electro-optical receiver for receiving the light from said first optical means and guiding said light into said electro-optical receiver;

said first and second optical means being comprised of first and second planar optical guide means, respectively, each comprising a flattened plate of dielectric material having two parallel major surfaces, a light inlet surface and a light outlet surface disposed in planes orthogonal to said major faces, the light inlet surface of said first planar optical guide means being coupled to said light emitting source and the outlet surface of said second planar optical guide means being coupled to said electro-optical receiver, said inlet and outlet surfaces of said first and second planar optical guide means being rectangular whereby a light beam emitted from said first planar optical guide means and crossing said detecting area to said second planar optical guide means has a rectangular cross-section with substantially uniform distribution of light intensity throughout said cross-section; said electro-optical receiver being adapted to emit an electrical signal indicative of light energy received by said second planar optical guide means; said device further comprising an electronic control unit connected to said electro-optical receiver for receiving the signal emitted by said electro-optical receiver and processing said signal to detect a defective needle passing through the detecting area.

2. A device according to claim 1, wherein said electronic control unit further comprises:

extracting means adapted to extract from said signal emitted by said electro-optical receiver output signals relating to said needles independent from variations relating to environmental operations; comparing means for comparing said output signals relating to one of said needles with output signals relating to a preceding one of said needles which has already passed through the detecting area whereby the monitoring of the needles is independent from variations relating to the type and width of the needles, operating conditions of the knitting machine and initial calibrating operations of the device.

3. A device according to claim 1, further comprising support means for adjustably supporting said optical head on a fixed part of the knitting machine, said support means comprising a first element fixable on said fixed part of the knitting machine being adjustable in a first direction and a second element fixable on the first element being adjustable along a second direction orthogonal with respect to said first direction.

4. A device according to claim 1, wherein said main support structure has a bridge-like configuration with two side elements carrying said light emitting source and said electro-optical receiver, respectively.

5. A device according to claim 1, wherein said main support structure is located on one side of a path along which said needles move and a reflecting element mounted on the other side of said path for reflecting light energy emitted by said light source toward said electro-optical receiver.

6. A device according to claim 1, wherein said outlet surface of said first planar optical guide means and the inlet surface of said second planar optical guide means are disposed parallel to a main axis of the needle passing through said detecting area.

7. A device according to claim 1, wherein said optical head is inclined so that the light beam is disposed at an angle different from 90° with respect to a main axis of the needle.

8. A device according to claim 1, wherein said optical head is rotated so that the light beam is disposed at an angle different from 90° with respect to a path of travel of the needles through said detecting area.

9. A device according to claim 1, wherein said detecting head is provided with transmission and reception windows aligned with said first and second planar optical guide means wherein said transmission and reception optical windows are each provided with cylindrical surfaces.

10. A device according to claim 2, wherein said extracting means comprises means adapted to extract from said signal emitted by said electro-optical receiver timing signals indicating passage of said needles in a detecting area.

11. A device according to claim 2, wherein said extracting means comprises means adapted to extract from said signal emitted by said electro-optical receiver, at least an output signal whose level is a function of waveforms of said signal emitted by said electro-optical receiver.

12. A device according to claim 11, wherein said extracting means comprises filtering means of the low-pass type adapted to filter said output signal, said filtering means operating in a condition of difference of phase null in frequency to generate a filtered output signal.

13. A device according to claim 12, wherein said extracting means comprise envelope demodulating means adapted to demodulate said filter output signal to generated a demodulated output signal, said demodulated output signal being delayed by a time interval corresponding to the passage of at least one needle.

14. A device according to claim 12, wherein said extracting means comprises level translating means adapted to move the level of said demodulated output signal as a function of a sensitivity parameter which is prearranged by selecting means.

15. A device according to claim 1, wherein said electronic control unit comprises aiding means for checking the installation of the device.

16. A device according to claim 2, wherein said electronic control unit comprises a processing unit 44 receiving an input signal generated by said comparing means to control actuating means and display means.

17. A device according to claim 1, wherein said electronic control unit comprises communication means adapted to render accessible for outside devices inside signals of said electronic control unit.

18. A device according to claim 1, wherein said electronic control unit provides a signal indicating state of cleanness of the surfaces having receiving and emitting windows.

19. A device according to claim 1, wherein said electronic control unit further includes actuating means for automatically stopping said knitting machine if said signal indicating a state of cleanness of the surfaces having the receiving and emitting windows passes a predetermined level.

* * * * *